US006731889B2

(12) United States Patent
Nakayama

(10) Patent No.: US 6,731,889 B2
(45) Date of Patent: May 4, 2004

(54) IMAGE FORMING APPARATUS AND PATCH DETECTION METHOD

(75) Inventor: Toshiki Nakayama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/232,662

(22) Filed: Sep. 3, 2002

(65) Prior Publication Data

US 2003/0044190 A1 Mar. 6, 2003

(30) Foreign Application Priority Data

Sep. 3, 2001 (JP) ..... 2001/265665

(51) Int. Cl.[7] ..... G03G 15/00
(52) U.S. Cl. ..... 399/49
(58) Field of Search ..... 399/49, 72, 299, 399/46

(56) References Cited

U.S. PATENT DOCUMENTS 6,181,888 B1 * 1/2001 Scheuer et al. ..... 399/49
6,501,916 B2 * 12/2002 Suzuki ..... 399/30
6,564,021 B1 * 5/2003 Nakai et al. ..... 399/49

* cited by examiner

*Primary Examiner*—Hoang Ngo
(74) *Attorney, Agent, or Firm*—Fitzpatrick, Cella, Harper & Scinto

(57) ABSTRACT

There is provided an image forming apparatus having good color reproductivity as well as a toner patch detection method, in which reflected light from a toner patch can be detected with a good S/N ratio based on a small quantity of light, and the color tint and density of the toner patch can be detected under limited time and a limited length of an intermediate transfer member or transfer material, without wasting the toner. A detecting operation of an accumulation type sensor for detecting a toner patch to be used for controlling at least one of density, tone reproduction and color tint of a toner image formed on a transfer material is controlled in accordance with a timing of detection by a synchronization circuit, of a toner patch for position detection formed on the transfer material.

26 Claims, 13 Drawing Sheets

IMAGE FORMING APPARATUS AND PATCH DETECTION METHOD

BACKGROUND OF THE INVENTION

1. Field of the Invention

The present invention relates to an image forming apparatus such as a copying machine or a printer or the like that uses an electrophotography scheme or an electrostatic storage scheme or the like. Specifically, the present invention relates to improvements of such an apparatus in the density, tone reproduction and color tint of its toner images.

2. Description of the Related Art

FIG. 13A schematically shows an example of a sensor utilizing a photodiode for detecting light reflected from toner. FIG. 13B shows an example of a circuit that converts an output current of the photodiode into a voltage. In FIGS. 13A and 13B, reference numeral 201 denotes a photodiode, and reference numeral 102 denotes an LED serving as a light source. Reference numeral 104 denotes a toner image (which will be referred to as a "toner patch" hereinafter) to be detected that has been formed on a transferring material. Reflected light 206 from the toner patch is incident on the photodiode 201, so that a photocurrent is generated. The photocurrent is converted into a voltage V203 by a resistance 202. The voltage V203 reflects the quantity of reflected light in real time.

FIG. 14 is a block diagram showing a structure of a conventional accumulation type line sensor. In FIG. 14, reference numerals 204, 205 and 206 denote a sensor array, a readout circuit and a reset circuit respectively. Pixels 207 to 209 and 220 are dark pixels surfaces of which are shielded from light. Pixels 210 to 219 are sensitive to light. Pixels 207 and 220 also serve as dummy pixel that are disposed at the ends of the sensor array to absorb variations in characteristics of the sensor due to their locations at the ends. For the sake of simplicity, an example that includes ten light sensitive pixels is shown in FIG. 14, but it should be noted that the number of effective pixels is determined in accordance with various requirements. In this example, the dark pixels comprise three bits located at the front end and one bit located at the rear end, but it should also be noted that the number of bits would be increased or decreased in accordance with the extent of light leakage between pixels or with requirements posed on the system to be used.

FIG. 15 is a timing chart showing an operation of the accumulation type line sensor shown in FIG. 14. The accumulation is started upon releasing a reset status after the sensors are reset with a reset pulse 221. During the accumulation, accumulation capacities (not shown) of the sensors are charged by photocurrents corresponding to the incident light quantities. However, in those bits which are shielded from the light, the accumulation capacities are charged by dark currents generated in the sensors. After a predetermined time ta of the accumulation, the outputs of the sensors are transferred with a transfer pulse 222 to the readout circuit 205 at one time. Then they are output, pixel by pixel, in a serial manner as an output signal 224, based on shift pulses 223 generated by a shift register in the readout circuit. In this process, the output corresponding to the dark pixel 208 is taken as a representative dark output, so that that output is subtracted from each of the outputs of the subsequent effective pixels to obtain a corrected signal that compensates for an error due to the dark current of the sensor.

A description will be made of the outline of an overall structure of a color laser printer as a multi-color image forming apparatus. The color laser printer forms an electrostatic latent image in an image forming unit in accordance with an image light generated based on an image signal, and then develops the electrostatic latent image so as to form a color visible image, and further transfers the color visible image onto a transfer material as a recording medium, and fixes the color visible image. The image forming unit includes, for stations arranged in parallel corresponding to respective developing colors, photosensitive drums 5Y, 5M, 5C and 5K, injection charging means 7Y, 7M, 7C and 7K as primary charging means, developing means 8Y, 8M, 8C and 8K, and toner cartridges 11Y, 11M, 11C and 11K. The image forming unit also includes an intermediate transfer member 12, a sheet feeding unit, a transferring unit and a fixing unit 13.

The photosensitive drums 5Y, 5M, 5C and 5K are comprised of aluminum cylinders coated with an organic photoconductive layer on their peripheral surfaces. These photosensitive drums are rotated by a driving force transmitted from a driving motor (not shown), which causes the photosensitive drums 5Y, 5M, 5C and 5K to rotate counterclockwise in accordance with image forming operations. Exposing lights for the photosensitive drums 5Y, 5M, 5C and 5K are transferred from scanner units 10Y, 10M, 10C and 10K so as to selectively expose the photosensitive drums 5Y, 5M, 5C and 5K, so that electrostatic latent images are sequentially formed.

As primary charging means for charging the yellow (Y), magenta (M), cyan (C) and black (K) photosensitive drums, four injection charging means 7Y, 7M, 7C and 7K are provided for the respective stations. The injection charging means 7Y, 7M, 7C and 7K are equipped with sleeves 7YS, 7MS, 7CS and 7KS respectively.

As developing means for making the electrostatic latent image visible, four developing devices 8Y, 8M, 8C and 8K that perform developments in yellow (Y), magenta (M), cyan (C) and black (K) are provided for the respective stations. The developing devices 8Y, 8M, 8C and 8K are equipped with sleeves 8YS, 8MS, 8CS and 8KS respectively. Each of the developing devices is detachably mounted on the body of the apparatus.

The intermediate transfer member 12 is composed of an endless belt looping around a driving roller 18*a* and driven rollers 18*b* and 18*c*, which is in contact with photosensitive drums 5Y, 5M, 5C and 5K. At the time of color image formation, the intermediate transfer member 12 is rotated clockwise so as to be sequentially transferred with images by means of primary transferring rollers 6Y, 6M, 6C and 6K of respective colors.

A sheet feeding cassette 2 or a sheet feeding tray 3, which serves as sheet feeding means (or a sheet feeding opening), accommodates transfer materials 1. The transfer materials 1 are transported through a transporting path 25 defined by feed rollers 4, transporting rollers 24 etc. so as to be delivered to registration rollers 23. The arrival of the transfer material 1 at the registration roller 23 is detected by a sensor 19 positioned before the registration roller 23.

During the formation of the image, the transportation of the transfer material 1 is suspended for a predetermined time in synchronization with the time, which is determined based on the detection by the sensor 19 before the registration roller, at which a color visible image on the intermediate transfer material 12 would arrive at a transferring area. The transfer material 1 is fed to the transferring area at which a secondary transferring roller 9 is in contact with the intermediate transfer member 12 to receive and transport the transfer material 1 therebetween, whereby color visible images on the intermediate transfer member 12 are transferred onto the transfer material 1 at one time in a superposed manner.

While the color visible images are transferred in a superposed manner, the secondary transferring roller 9 assumes a position shown by a solid line in FIG. 16, at which the secondary transferring roller 9 keeps the transfer material 1 in contact with the intermediate transfer member 12. However, after completion of the printing process, the secondary transferring roller 9 is shifted apart from the intermediate transfer member 12 to a position shown by a broken line in FIG. 16.

The fixing unit 13 functions to fix the transferred color visible image while transporting the transfer material 1. The fixing unit 13 has a fixing roller for heating the transfer material 1 and a pressurizing roller 15 for pressing the transfer material against the fixing roller 14. The fixing roller 14 and the pressurizing roller 15 have hollow structures and accommodate a heater 16 and 17 respectively. Thus, the transfer material 1 that bears the color visible image is applied with heat and pressure so that the toner is fixed on the surface of the transfer material 1, while the transfer material 1 is transported by the fixing roller 14 and the pressurizing roller 15.

After the fixing of the visible image, the transfer material 1 is discharged to a discharging unit (not shown) by a discharging roller (not shown), so that the image forming operation is completed. The discharge of the transfer material 1 from the fixing unit 13 is detected by a fixing discharge sensor 20.

Cleaning means 21 collects waste toner remaining on the intermediate transfer member 12 after transferring the four color visible images formed on the intermediate transfer member 12 onto the transfer material 1.

Color misregistration detecting means 22 forms a color misregistration detecting pattern on the transfer material 1 and detects misregistration amounts between the colors with respect to a main scanning direction and a sub-scanning direction to provide feedback for fine adjustment of the image data so as to reduce color misregistration.

Changes in conditions of some portions of the image forming apparatus due to changes in environmental conditions or due to long term use of the apparatus bring about changes in the density or chromaticity of the obtained images. Especially in the case of color image forming apparatus using an electrophotography scheme, a slight change in the density can deteriorate the color balance, so it is necessary to always keep a constant density, a constant tone and a constant color tint.

For that purpose, the image forming apparatus is provided with tone correcting means in the form of a look-up table or processing conditions such as a plurality of exposure amounts or developing biases corresponding to absolute humidity for each color toner etc., so that a processing condition or tone correcting value to be used is selected based on the absolute humidity measured by a temperature and humidity sensor (not shown).

In addition, in order to maintain a constant density, tone and color tint (which may be called image formation characteristics) irrespective of changes in conditions of portions of the apparatus during use, the apparatus forms toner patches for density detection on the intermediate transfer member with respective colors of toner, and detects the toner patches using an optical sensor disposed at a position similar to the color misregistration detecting means 22 so as to provide feedback to processing conditions such as an exposure amount or a developing bias to perform density control in order to ensure stable images.

However, use of conventional sensors for detection of the color tint of the toner patches on the sheet after the fixing or detection of the density of the toner patches on the intermediate transfer member for the purpose of obtaining stable images in the image forming apparatus has involved the following problems.

First, in the sensor utilizing a photodiode shown in FIG. 13A, since a photocurrent generated in a photo-receiving portion is directly subjected to I/V conversion (i.e. current-to-voltage conversion), it is difficult to secure a sufficient quantity of light that can create a sensor output having a good S/N ratio. When the toner density on the intermediate member is detected utilizing diffused reflected light from the toner patch, the regular reflected light is eliminated from the reflected light for detection, so the quantity of light available for the detection is reduced. In addition, in order to perform the γ-correction, it is necessary to detect reflected light from patches of various toner reflectances. Therefore, it is necessary to detect a patch(s) of low reflectance, in which case the quantity of incident light on the sensor is further reduced.

Furthermore, when the diffused reflected light is made to pass through color filters such as R (red), G (green) and B (blue) for selective detections in order to detect the color tint of the toner on the sheet, the quantity of light is still further reduced, since the wavelength range of the incident light on one pixel of the sensor is restricted. When detection is performed on light having been diffracted by a diffraction grating or the like, the quantity of light is greatly reduced, since the incident light on each pixel of the sensor has a more narrow wavelength range.

It is true that the voltage can be increased by increasing the value of the resistance used for the I/V conversion, but in that case, the S/N ratio cannot be significantly enhanced, since random noises generated in the resistance also increase or the sensor becomes susceptible to external noises. It is also true that the quantity of incident light on the sensor can be increased by converging the light with a lens, but in this case, the optical system becomes more complex and increases costs.

On the other hand, in the case of the accumulation type sensor shown in FIG. 14, a good S/N ratio can be obtained even if a sufficient quantity of light is not available, since it accumulates in the accumulation capacity the photocurrent generated in the light receiving portion and reads the accumulated charge. However, in this sensor, changes in incident light cannot be detected in real time, so it is not possible to detect the position of the leading edge of the toner patch to be detected. So the timing for starting the sensor accumulation must be determined based on the timing of forming the electrostatic latent image of the toner patch to be detected on the photosensitive drum. In this case, it is necessary to form a large size of patch, since there is a variation in the time required for the toner patch to be delivered to the detection area of the sensor. In the case in which the toner density is detected by detecting a toner patch on the intermediate transfer member, the enlargement of the toner patch size causes an increase in the time required for detecting the toner patch for toner density detection, so as to bring about problems such as a decrease in the usability of the apparatus and economical inefficiency due to an increase in waste toner. On the other hand, in the case in which the toner density is detected by detecting a toner patch on the sheet after the fixing, the enlargement of the toner patch size causes a decrease in the number of the toner patches that can be formed on a sheet of a predetermined size, so as to bring about problems such as a decrease in detectable information and a decrease in accuracy in color stabilization control of the image forming apparatus.

SUMMARY OF THE INVENTION

The present invention has been made under the above-mentioned situation. It is an object of the invention to provide an image forming apparatus having good color reproductivity as well as a toner patch detection method, in which reflected light from a toner patch can be detected with a good S/N ratio based on a small quantity of light, and the color tint and density of the toner patch can be detected under limited time and a limited length of an intermediate transfer member or transfer material, without wasting the toner.

An image forming apparatus according to the present invention comprises image forming means for forming an image, patch forming means for causing said image forming means to form a patch for image formation characteristics detection and a patch for position detection, first detecting means for detecting a patch for image formation characteristics detection formed by said image forming means in order to control an image forming condition, second detecting means for detecting a patch for position detection, and controlling means for controlling, in response to the detection by said second detecting means, a detecting operation of said first detecting means.

According to the present invention, there is also provided a method for detecting a patch for controlling image formation characteristics of an image forming apparatus, using a first sensor and a second sensor, comprising a step of causing the image forming apparatus to form a patch for image formation characteristics detection and a patch for position detection, a step of detecting the patch for position detection formed by said image forming apparatus, using the second sensor, a step of controlling, in response to detection by said second sensor, a detecting operation of said first sensor, and a step of detecting the patch for image formation characteristic detection formed by said image forming apparatus based on detection by said first sensor so as to obtain information on image formation characteristics of said image forming apparatus.

This and other objects, features and advantages of the present invention will become apparent upon consideration of the following description of the preferred embodiments of the present invention taken in conjunction with the accompanying drawings.

DETAILED DESCRIPTION OF THE PREFERRED EMBODIMENTS

In the following, the present invention will be more specifically described based on its embodiments in the form of image forming apparatus. It should be noted that embodiments of the present invention are not limited to the form of apparatus, but the invention can be embodied as methods, which also will be supported by the following description.

First Embodiment

Figure 1:
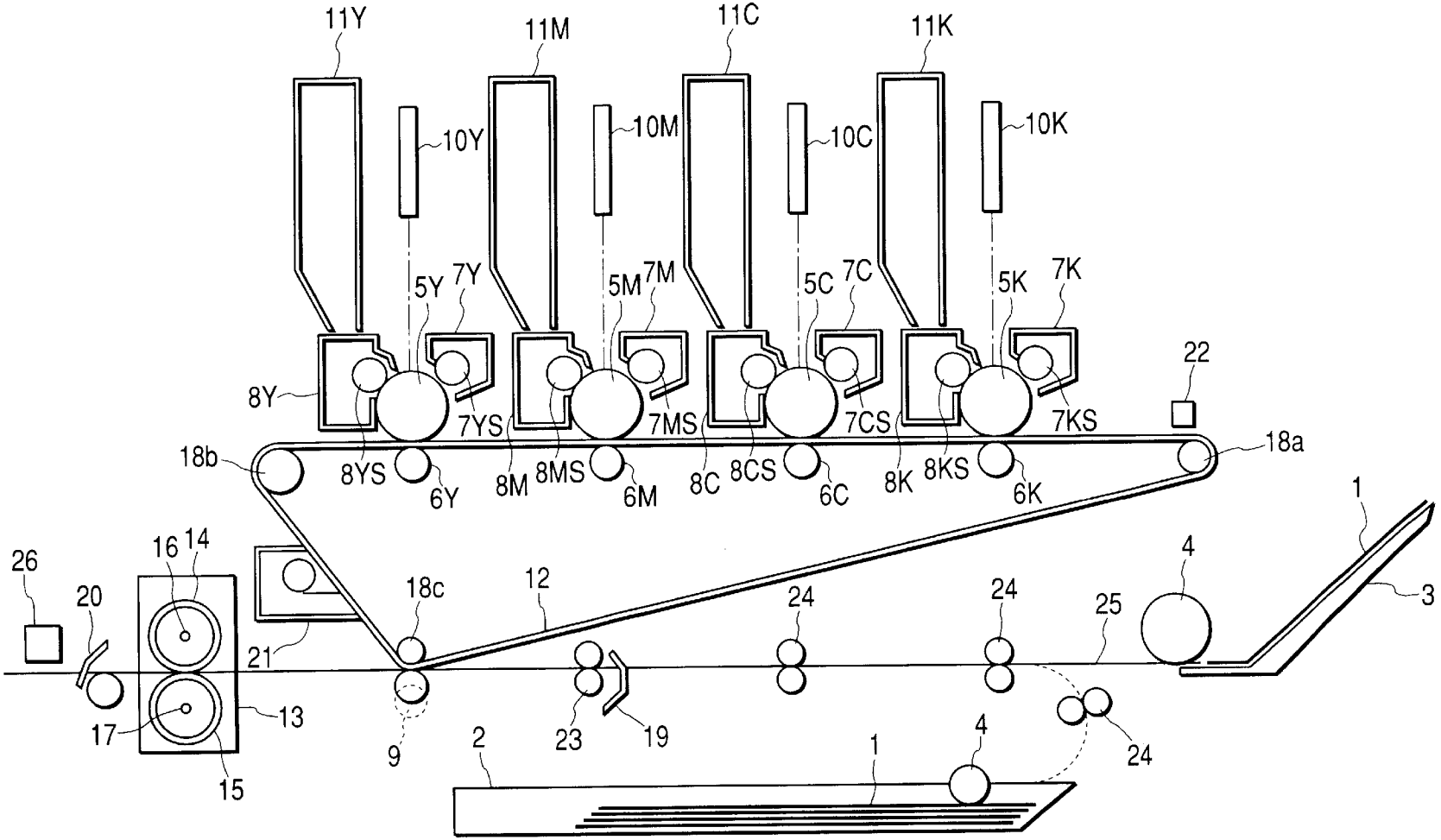
FIG. 1 is a drawing showing an overall structure of the first embodiment of the present invention.
Figure 16:
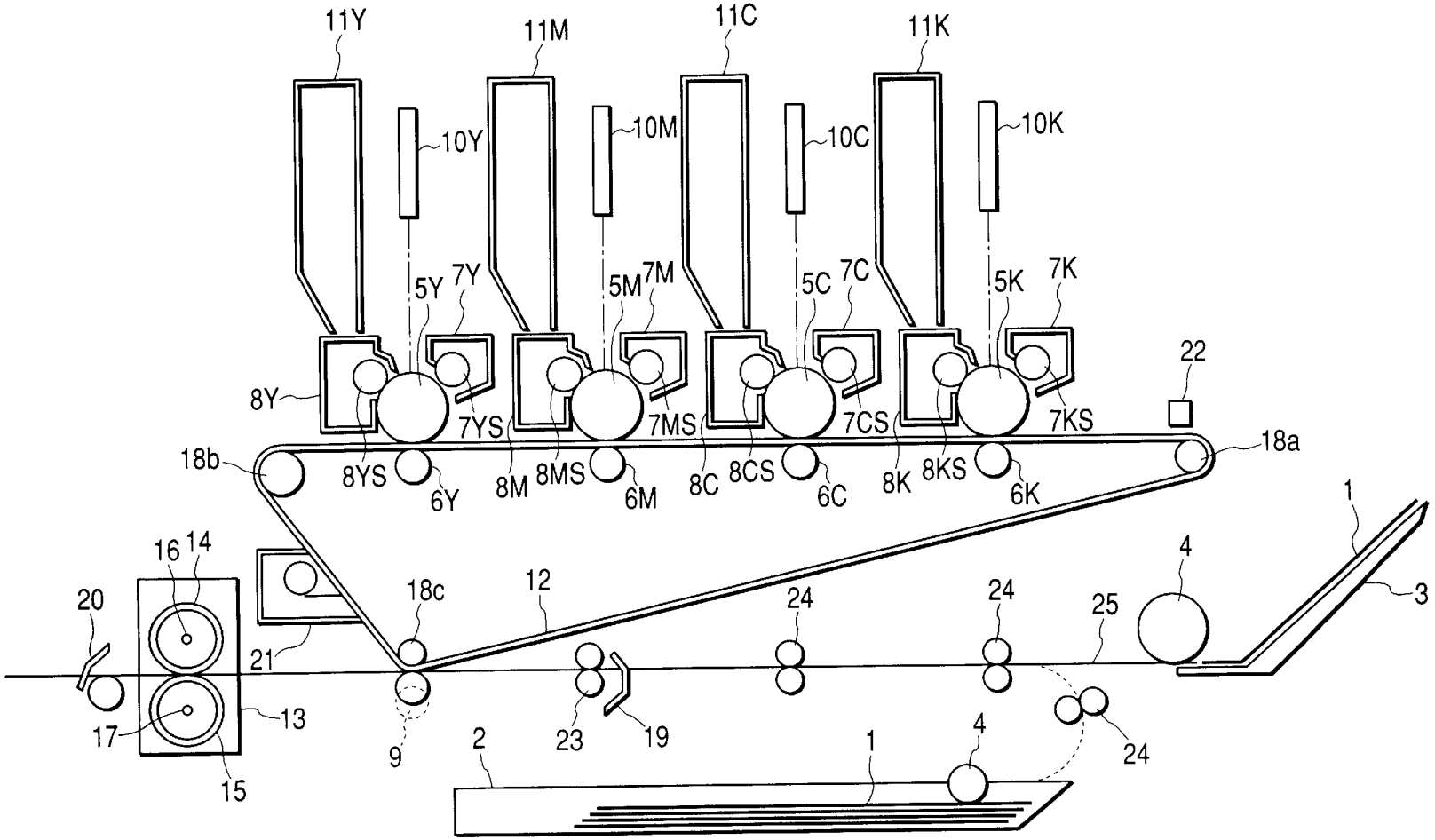
FIG. 16 is a drawing showing a structure of an image forming apparatus of a prior art.

FIG. 1 shows a hardware structure of an image forming apparatus as the first embodiment of the present invention. The structure is the same as that of the apparatus shown in FIG. 16 except for provisions of a synchronization circuit and a accumulation type sensor (both of which will be described later) at a position 26, so reference is made to the description in connection with FIG. 16 presented above to omit detailed descriptions that would be redundant.

Figure 2:
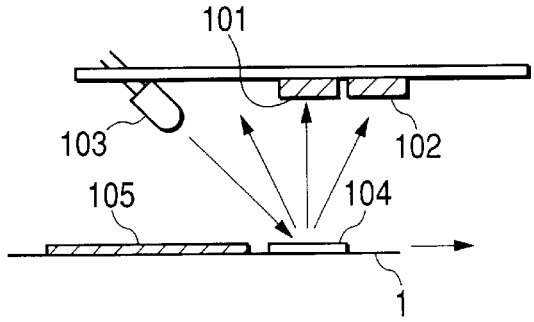
FIG. 2 is a drawing showing a positional relationship of an accumulation type sensor, a synchronization circuit, a light source and toner patches.
Figure 3:
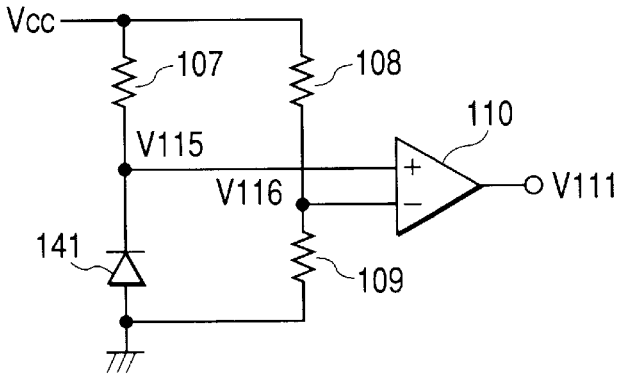
FIG. 3 is a schematic circuit diagram of the synchronization circuit.
Figure 4:
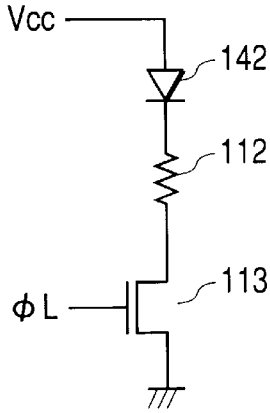
FIG. 4 is a schematic circuit diagram of a driving circuit for an LED serving as the light source.
Figure 5:
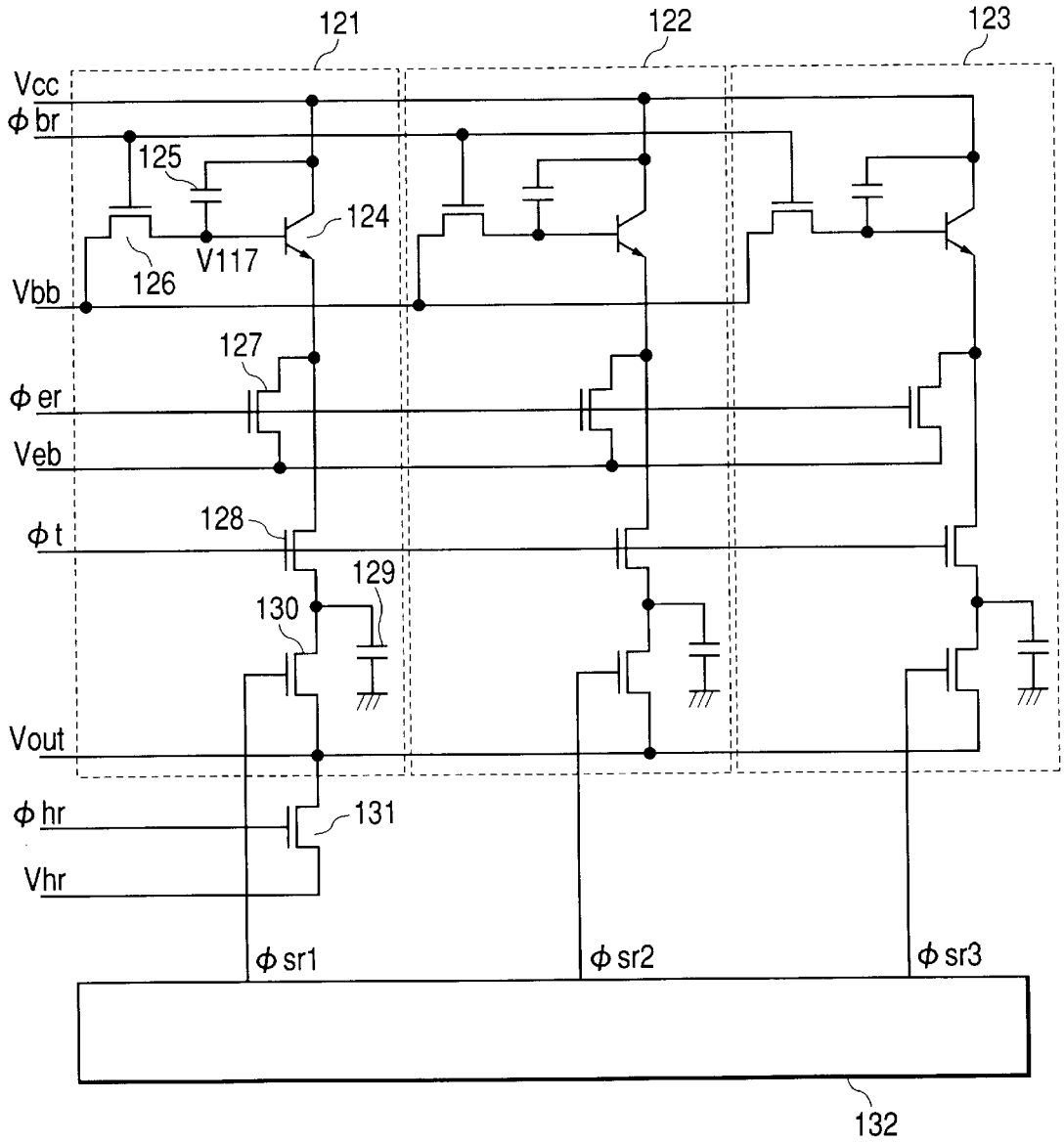
FIG. 5 is a schematic circuit diagram of the accumulation type sensor.
Figure 6:
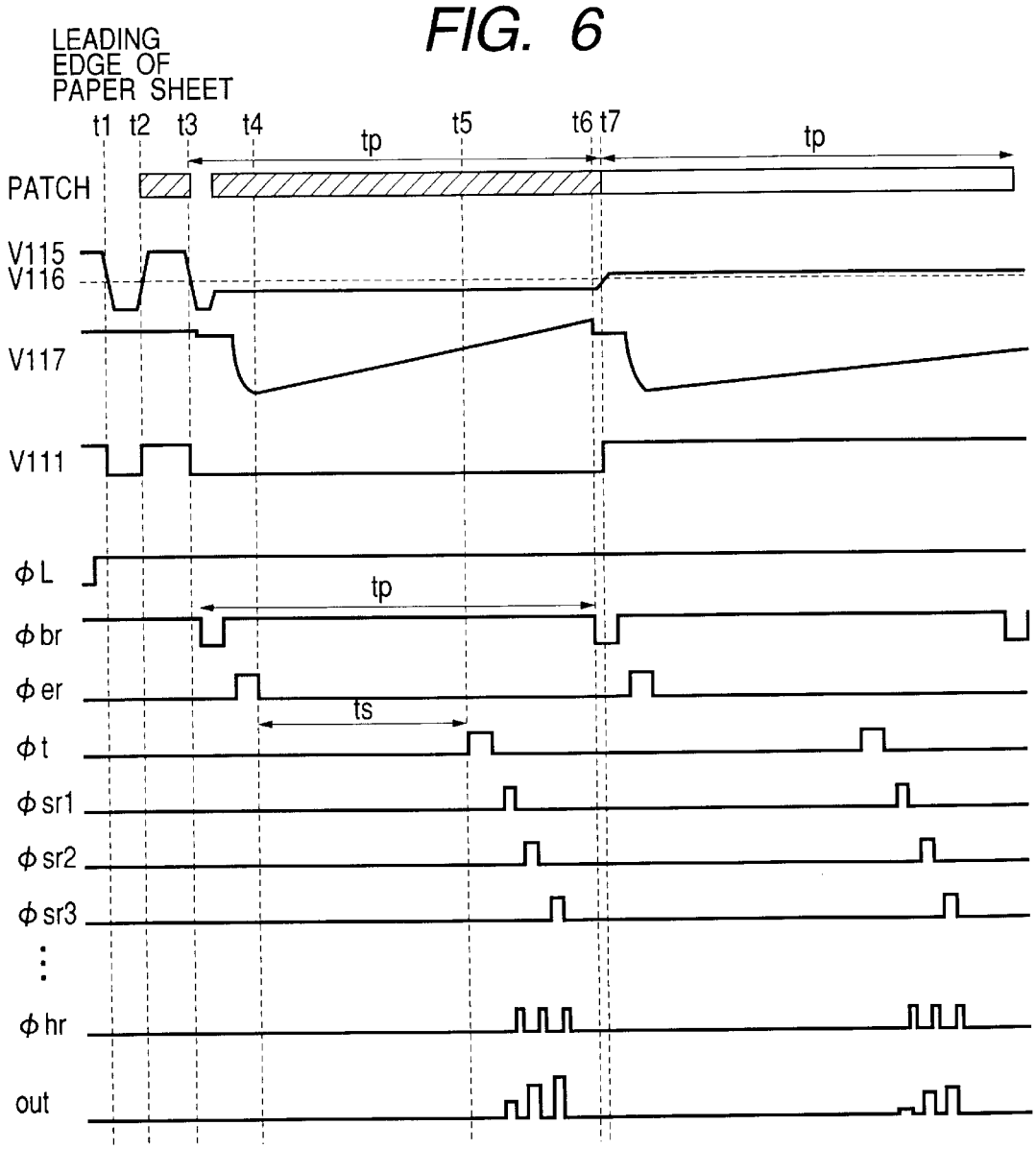
FIG. 6 is a timing chart showing the operation of the accumulation type sensor and the synchronization circuit.

FIG. 2 shows a relationship of the synchronization circuit, the accumulation type sensor, a light source and toner patches. FIG. 3 shows a schematic circuit diagram of the synchronization circuit for determining the operation timing of the accumulation type sensor. FIG. 4 is a schematic circuit diagram of a driving circuit for an LED that serves as the light source. FIG. 5 shows a schematic circuit diagram of the accumulation type sensor. FIG. 6 shows a timing chart (concerning the operations of the accumulation type sensor and the synchronization circuit) of toner patch detection performed with the present embodiment.

First, a description will be made with reference to FIG. 2. Reference numeral 101 denotes the accumulation type sensor, the details of which are shown in FIG. 5. Reference numeral 102 denotes the synchronization circuit, the details of which are shown in FIG. 3. Reference numeral 103 denotes the light source, the details of which are shown in FIG. 4. Light emitted from the light source 103 is incident on a toner patch 104 for position detection (i.e. a toner patch to be used for detecting a position) and a toner patch 105 for color tint detection or density detection (i.e. a toner patch to be used for detecting color tint or for detecting density) with an angle of incidence of about 45 degrees and reflected diffusely by the toner surface to spread above. The accumulation type sensor 101 detects the defused reflection component of this reflected light. The synchronization circuit shown in FIG. 3 is comprised of a comparator 110, resistances 108 and 109 for dividing a voltage to provide a constant voltage V116, a photodiode 141 and a resistance 107 for I/V-converting (i.e. current-to-voltage converting) a photocurrent generated by the photodiode 141. The photodiode 141 that monitors the quantity of light on the transfer material need not to be covered with a color filter, since it is used only for detecting a presence/absence of the toner patch for position detection. Therefore, the photodiode 141 does not involve any decrease in the quantity of incident light caused by the presence of the filters. Since there is needed only one sensor, unlike accumulation type sensors comprised of a plurality of pixels, the size of the photodiode need not to be made small, so that it does not suffer from insufficiency in the quantity of light. Furthermore, since the photodiode 141 is not required to have a good S/N ratio, a sensor that uses a normal photodiode (or phototransistor, alternatively) can efficiently serve as the photodiode 141.

When the photodiode 141 is receiving reflected light from the transfer material in the form of, for example, a paper sheet, the generated photocurrent is relatively large as compared to that in the case of receiving reflected light from toner. Therefore, in this case, the voltage V115 on the cathode side is significantly smaller than the reference voltage V116, so that the output V111 of the comparator is low. When the photodiode 141 receives reflected light from the toner patch 104 for position detection, the photocurrent generated in the photodiode 141 decreases, so that the voltage V115 increases so as to invert the output V111 of the comparator 110 to high. When the toner patch 104 for position detection moves further and the photodiode receives the reflected light from the paper sheet again, the output V111 of the comparator 110 is inverted again to be low. Therefore, toner patch detection in accurate synchronization with a toner patch can be made possible by starting accumulation of the accumulation type sensor after the elapse of a predetermined time period (i.e. time interval between the toner patch for position detection and the subsequent toner patch for color tint detection or for density detection) from when the output V111 turns from high to low. As per the above, by monitoring the output of the synchronization circuit, it is possible to determine an accurate timing for driving the accumulation type sensor.

As shown in FIG. 4, the light source is comprised of an LED 142, a current-limiting resistance 112 and an NMOSFET 113 for switching on/off of the LED. When a control signal ϕL is low, the NMOSFET 113 is off and no current flows through the LED 142, that is, the LED 142 is off. On the other hand, when the control signal ϕL is high, the NMOSFET 113 is on and a current flows through the LED 142, so that the light source emits light. As per the above, on/off of the light source can be selected by switching high/low of the control signal ϕL. As a light source to be used for detecting the color tint of the toner, such a light source, such as a white LED, that has a spectrum spreading all over the visible light range is used. When only the toner density is to be detected, it is not necessary to use the white LED, but an infrared LED may be used.

In the following, the accumulation type sensor will be described with reference to FIG. 5. Reference numeral 121 denotes an equivalent circuit of one pixel of a bipolar accumulation type sensor BASIS (Base Stored Image Sensor). Reference numeral 124 denotes a bipolar transistor with a high current gain for detecting light. Reference numeral 125 denotes a capacity between the base and collector, which accumulates charge. Reference numeral 126 denotes a PMOSFET for resetting the base voltage to Vbb in accordance with a base reset signal ϕbr. Reference numeral 127 denotes an NMOSFET for effecting emitter resetting in accordance with an emitter reset signal ϕer. Reference numeral 128 denotes an NMOSFET for transferring outputs of the sensors to a capacity 129 at one time in accordance with a transfer signal ϕt. Reference numeral 130 denotes an NMOSFET for outputting the charge having been transferred to the capacity 129 to an output line Vout in accordance with an output ϕsr1 of a shift register 132. Reference numeral 131 denotes an NMOSFET for resetting the output line Vout to a voltage Vhr in accordance with an output line reset signal ϕhr.

In the arrangement shown in FIG. 5, the sensors are provided as three pixels (i.e. 121, 122 and 123) corresponding to respective colors of R (red), G (green) and B (blue). An on-chip color filter is provided on the surface of each pixel, so that a signal corresponding to one of R, G and B in the reflected light can be detected. By A/D-converting a signal output to the output line Vout, it is possible to obtain a signal corresponding to the light accumulated in a predetermined time for each of the wavelengths corresponding to R, G and B in the reflected light reflected by the toner surface. Each of the driving signals is supplied by a CPU (not shown) or the like that controls the operations of the image forming apparatus.

In the following, a description will be made of the operations of the synchronization circuit and the accumulation type sensor with reference to the timing chart shown in FIG. 6. The transfer material 1 (that is, a paper sheet, in this embodiment) is formed with toner patches. After the ϕL is made high and the light source is turned on, when at time t1 the leading edge of the paper sheet after the fixing arrives at a sensor unit that includes the synchronization circuit, the photodiode 141 starts to receive reflected light from the sheet surface, so that the output V111 becomes low. After that, when at time t2 the toner patch for position detection arrives at a detection area of the sensor, the comparator output of the synchronization circuit 102 is inverted, so that the output V111 becomes high. When at time t3 the toner patch for position detection leaves the detection area of the sensor, the comparator output of the synchronization circuit 102 is inverted, so that the output V111 becomes low. The CPU detects the second fall of the output V111 to start the operation of the accumulation type sensor 101, whereby it is possible to set the accumulation timing in synchronization with the toner patch position. More specifically, in response to the fall of the output V111, the sensor reset pulses ϕbr and per, each of which has a certain pulse width, are generated to reset the sensor 101. When the ϕbr becomes low, the PMOSFET 126 is turned on, so that the base of the transistor 124 is reset to Vbb. When the ϕer becomes high, the NMOSFET 127 is turned on, so that the emitter of the transistor 124 is reset substantially to Veb and the base potential decreases in accordance with the emitter potential. When at time t4 the ϕer becomes low, the transistor 124 enters a floating state at both the emitter and the base, so that the sensor starts the accumulation.

After the elapse of a predetermined accumulation time ts, the transfer signal ϕt is output at time t5, so that the accumulated signal is transferred to the capacity 129 and the accumulation is terminated. After that, the CPU causes the shift register 132 to operate so as to turn the NMOS 130 on, so that the sensor output is read out from Vout. The read-out signal is A/D-converted by an A/D converter (not shown) and stored in a memory of the CPU (not shown) that controls the operations of the image forming apparatus. After the output of one of the sensors is read out, the output line reset signal ϕhr becomes high, so that the output line is reset to Vhr by the NMOSFET 131. The shift register 132 turns the outputs ϕsr2 and ϕsr3 on successively, so that sensor outputs corresponding to the green and blue filters are read out subsequently.

After the signal corresponding to the first toner patch is read out, the processes of sensor reset, signal accumulation and readout are repeated at an time interval tp corresponding to the length of the toner patch (i.e. a time obtained by dividing the patch length by the patch velocity in the traveling direction of the patch), so that a plurality of patches for color tint detection and for density detection are detected. Thus, data used for various control processes of the image forming apparatus can be obtained.

When the above-described synchronization circuit and the accumulation type sensor are used as a sensor that detects the color of the toner on a paper sheet after the fixing or as a density sensor that detects the density of the toner patch after the fixing, they are disposed at an intermediate position 26 between the fixing unit 13 and the sheet discharging port (not shown), as shown in FIG. 1. In the detection process, the transferring material 1, which have been transferred with a toner patch for position detection and toner patches to be detected and fixed, is transferred to the detection area of the sensor. Even if there is a variation in transferring time, driving control of the accumulation type sensor in synchronization with the toner patch positions can be performed by detecting the timing of the arrival of the patch for position detection preceding the toner patches. Therefore, it is not necessary to set a margin for the toner patch size, so that many detection patches can be formed in a limited length of a sheet. Furthermore, the accumulation type sensor used herein can perform the detection with a high S/N ratio based on a little quantity of the reflected light, without requiring an additional lens mounted thereon or a plurality of light sources for increasing the quantity of light. Therefore, no additional costs are involved unlike sensors that read out an I/V-converted value of photocurrent directly.

As per the above, the outputs of the sensors for red, green and blue, which have detected reflected light from the fixed toner patches on the transfer material 1 using the accumulation type sensor, are obtained. Based on these sensor outputs, feedback control can be provided to tone correcting means in the form of a look-up table or processing conditions such as a plurality of exposure amounts or developing biases corresponding to absolute humidity for each color toner etc. so that desired color tint would be presented on the transfer material. In connection with this, since the number of the toner patches formed on the transfer material can be increased as described above, the control can be performed based on increased information, so accuracy in color stabilizing control can be enhanced.

Next, a description will be made of a case in which the above-described synchronization circuit and the accumulation type sensor are used as a density sensor that detects the toner density on the intermediate transfer member before the fixing. In this case, no color filters are required for the sensor, since the color is not detected. The number of pixel of the sensor may be one. Alternatively, a plurality of sensors may be provided in order to averaging non-uniformity depending on the position of the patch. The sensor is disposed at a position 22, which is the position at which a density sensor or color misregistration detecting means have been conventionally disposed. In this case also, driving control of the accumulation type sensor in synchronization with the toner patch positions can be performed by detecting the timing of the arrival of the patch for position detection preceding the toner patches at the detection area of the sensor. Therefore, it is not necessary to set a margin for the toner patch size, so required number of patches can be measured with a smaller toner amount and in a shorter detection time. Therefore, the usability of the apparatus can be enhanced, while stable images can be obtained by performing density control based on feedback given to processing conditions such as exposure value or developing bias. The operations of the other portions of the image forming apparatus are the same as the conventional apparatus shown in FIG. 16, so descriptions thereof are omitted. Referring to the toner patches, the intermediate transfer member is formed with single color toner patches, and the transfer material is formed with single color or multi-color toner patches.

As described in the foregoing, use of the accumulation type sensor realizes detection with a good S/N ratio based on a signal of a little quantity of light that has been originally generated as low diffused reflected light from the toner patches and attenuated through a color filter or by diffraction. Furthermore, by forming the patch for position detection to be detected by the synchronization circuit, it is possible to accurately detect arrival of the patches for color tint detection or for density detection at the detection area of the sensor. Therefore, it is not necessary to set a margin for the toner patch size, so the detection can be performed with a smaller toner amount and in a shorter detection time. Therefore, color stability of the image forming apparatus as well as the usability thereof can be enhanced.

In the foregoing, the description has been made of the embodiment in which three sensors covered with three filters (i.e. R, G and B filters) are used for toner color detection. However, the number of the sensors is not limited to three. Namely, a plurality of dummy pixels may be provided at the both sides of the sensors, or a plurality of pixels may be provided for each of the R, G and B filters so that accuracy of the detection would be enhanced by averaging positional non-uniformity of the toner patches based on a sum or average of the outputs of those pixels. Furthermore, the transmission wavelengths of the filters are not limited to R, G and B. The same advantageous effects will also be provided by using line sensors that have a number of sensors on which different wavelength ranges of light are incident in connection with a spectrophotometry method using a diffraction grating or a prism. Furthermore, the same advantageous effects will also be provided by detecting reflected light from the toner patches with a single sensor while switching a plurality of light sources having different emission wavelengths such as red, green and blue LEDs. In this embodiment, the base stored image sensor (BASIS) is used as the accumulation type sensor. However, the invention poses no limitation on the type of the accumulation type sensor. Other accumulation type sensors such as CMOS sensors or CCDs may also be used. In this embodiment, the image forming apparatus is of a tandem type, but the toner patch detection method of the invention is not limited for use in the tandem type. The method also advantageously applies to image forming of a one-drum type.

As described above, in this embodiment, the accumulation type sensor is used for color tint detection or density detection of the toner on the paper sheet or on the intermediate transfer member, so it is possible to obtain a signal having a good S/N ratio based on a little quantity of diffused reflected light from the toner patches, even if the quantity of light is further reduced by passing through a color filter or through a diffraction grating or a prism for spectrophotometry. Furthermore, the image forming apparatus forms the toner patch for position detection at the headmost position of the toner patches and has the synchronization circuit for detecting this toner patch for position detection, so that it is possible to determine accurate timing of arrival of the patches for color tint detection or density detection at the detection area of the sensor. Therefore, it is not necessary to set a margin for the toner patch size, and an increased number of detection patches can be formed in a limited time and in a limited length of the intermediate transfer member or transfer material, so that information to be used for color stabilization control can be increased while enhancing the usability of the apparatus. In other words, it is possible to provide an image forming apparatus having good color stability without reducing the usability.

Second Embodiment

Figure 7:
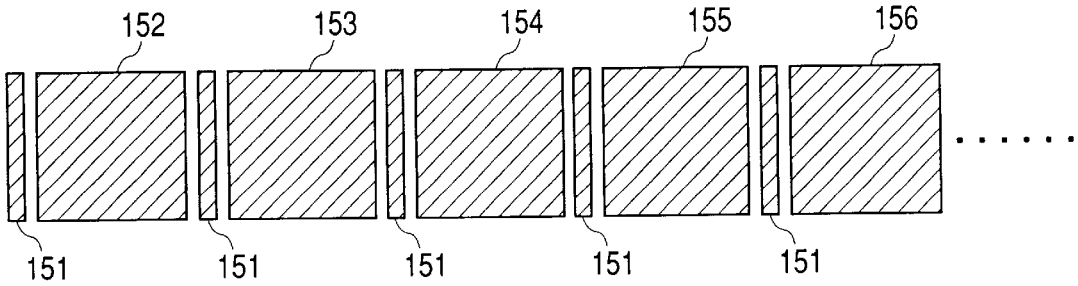
FIG. 7 is a drawing illustrating toner patches used in the second embodiment of the present invention.
Figure 8:
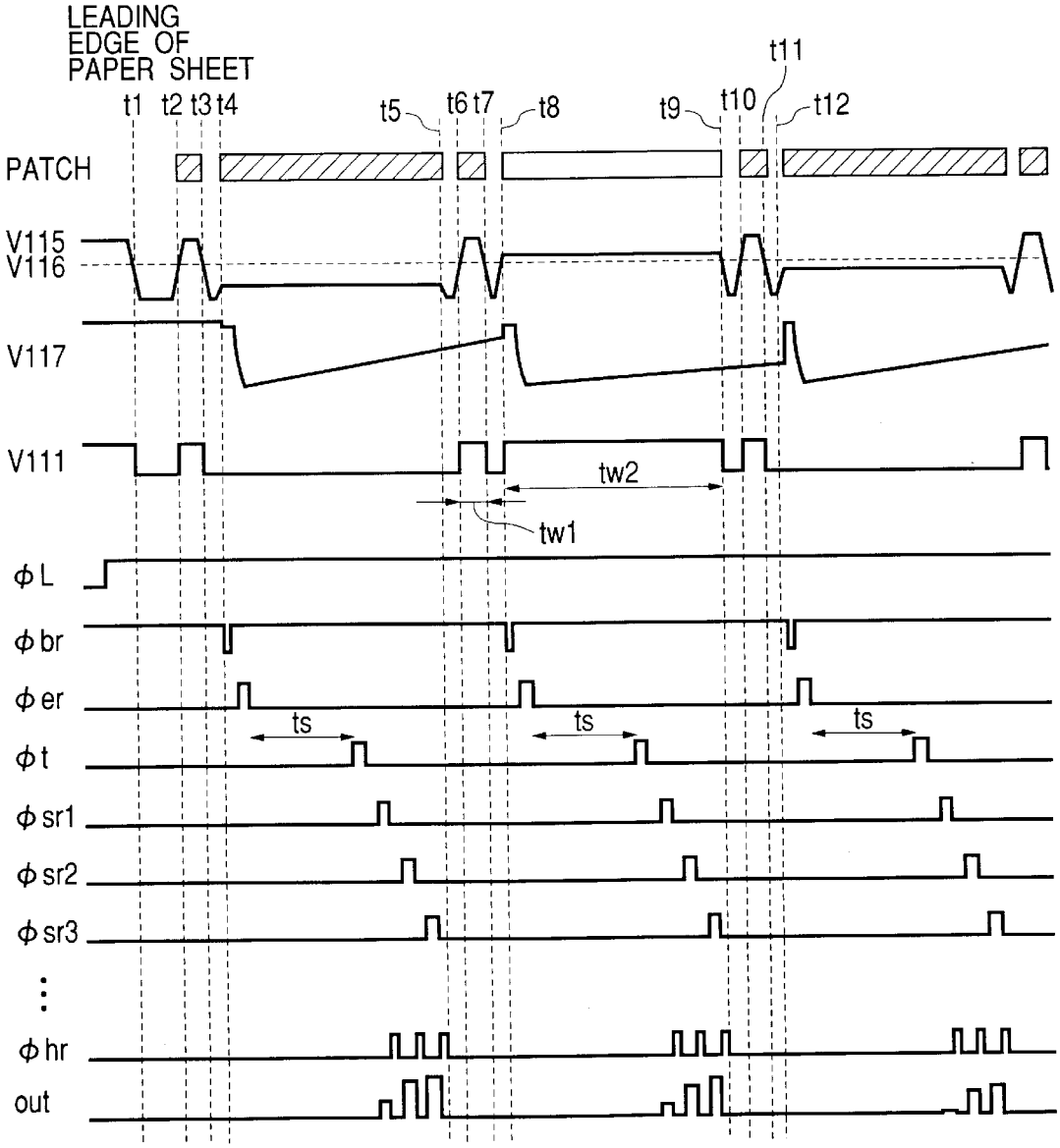
FIG. 8 is a timing chart showing the operation of the second embodiment.

FIG. 7 shows an example of toner patches for use in an image forming apparatus as the second embodiment of the invention. FIG. 8 shows a timing chart of an operation of this embodiment.

In the first embodiment described above, the patch for position detection disposed at the headmost position of the toner patches is detected by the synchronization circuit, and detection result is used for controlling the operation of the accumulation type sensor for detecting the subsequent patches. In this apparatus, if the transferring speed of the transfer material changes during the detection due to slippage caused by, for example, wear of a roller for driving the transfer material, disagreement in timing may occur between the toner patch position and the signal detection by the sensor. This would cause a problem that all of the data subsequently obtained can be erroneous and abnormal images would be produced if the color correction of the image forming apparatus is performed based on that data. If the abnormal state is detected or found based on the measured data and data used for the correction is obtained again in order to avoid the above problem, time and transfer material are wasted, so that the usability of the apparatus is reduced.

In view of the above, the apparatus of this embodiment forms a plurality of patches for position detection so as to avoid the detection error, even if the changes in the transferring speed occur. Thus, as shown in FIG. 7, a patch 151 for position detection is provided in front of every toner patch 152 to 156 for color tint detection or density detection.

The hardware structure of this embodiment is the same as that of the first embodiment except for the shape of the toner patch, so the reference is made to FIGS. 1 to 4 as well as the related descriptions presented above and redundant descriptions will be omitted.

The operation of the apparatus using the toner patches shown in FIG. 7 will be described with reference to a timing chart shown in FIG. 8. First, the CPU turns the control signal $\phi L$ to high so as to turn the LED 142 on. Unless the transfer material 1 arrives at the detection area of the sensor, light is not incident on the sensor 141 of the synchronization circuit 102 and the monitor output V115 is high. When at time t1 the transfer material 1 having been transferred with the toner patches arrives at the detection area of the sensor including the synchronization circuit 102, the sensor receives reflected light from the transfer material 1, so that the monitor output V115 is turned to low. When at time t2 the first toner patch for position detection arrives at the detection area of the sensor, the reflected light is greatly reduced, and the monitor output V115 increases to exceed the reference voltage V116, so that the output of the comparator 110 is inverted. Accordingly, the output V111 of the synchronization circuit becomes high. When at time t3 the toner patch for position detection leaves the detection area, the reflection light is increased, so that the output of the comparator 110 of the synchronization circuit 102 is inverted and the output V111 becomes low. The CPU detects this second fall of the output V111 to control the operation of the accumulation type sensor 101, so that the setting of the timing of the accumulation in synchronization with the positions of the toner patches is made possible.

The operations concerning the resetting, accumulation and readout of the accumulation type sensor 101 in this embodiment are the same as those in the first embodiment, and the descriptions thereof will be omitted. In this embodiment, the toner patch for position detection is provided in front of each of the toner patches for color tint detection or density detection. Therefore, after the sensor output corresponding to the first toner patch for color tint detection or density detection is read out, the synchronization circuit 102 enters a monitor state for monitoring the output V111 of the comparator. When at time t7, the trailing edge of the next toner patch for position detection (i.e. the falling edge of the output V111) is detected the CPU causes the accumulation type sensor 101 to start the next cycle of the operations such as resetting, accumulation and readout. In this connection, in the case in which the reflectance of a toner patch for color tint detection or density detection is low, the output V111 of the comparator 110 becomes high even during the detection of that toner patch (for example, as shown in the time interval between t8 and t9 in the chart of FIG. 8). In view of this fact, the CPU determines whether the output is a signal from a toner patch for position detection or from a toner patch for color tint detection or density detection based on the pulse width of the signal of the output V111, which utilizes the fact that the toner patch for position detection is made shorter than the toner patch for color tint detection or density detection, since the detection of the toner patch for position detection does not require the accumulation. As shown in FIG. 7, there is a gap between the toner patch for position detection and the toner patch for color tint detection or density detection. The output V111 of the comparator once becomes low between the toner patch for position detection and the toner patch for color tint detection or density detection, upon detection of reflection light from the transfer material 1 at that gap. Upon monitoring a pulse width (tw1 or tw2 in FIG. 8), if the signal level does not fall to low after the elapse of a time corresponding to the width of the toner patch for position detection, it is determined that the detected signal corresponds not to the toner patch for position detection but to the toner patch for color tint detection or density detection, so that errors in the operations can be avoided.

By repeating the above-described process, it is possible to perform the operations of the accumulation type sensor 101 in synchronization with the arrivals of the toner patches at the detection area of the sensor throughout the toner patches. In addition, even if the above-mentioned problem such as slippage of the transfer material 1 due to wear of a roller occurs, the color tint or density of the toner patches can be detected accurately, so that it is possible to obtain reliable data to be used for various controls of the image forming apparatus.

Embodiment 3

Figure 9:
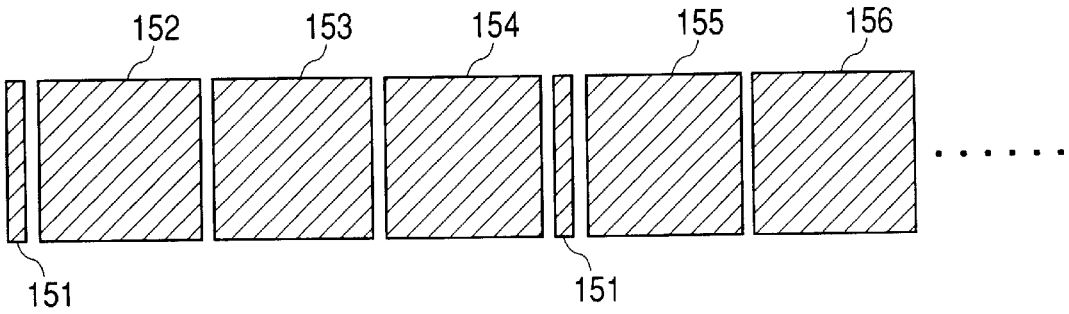
FIG. 9 is a drawing illustrating toner patches used in the third embodiment of the present invention.
Figure 10:
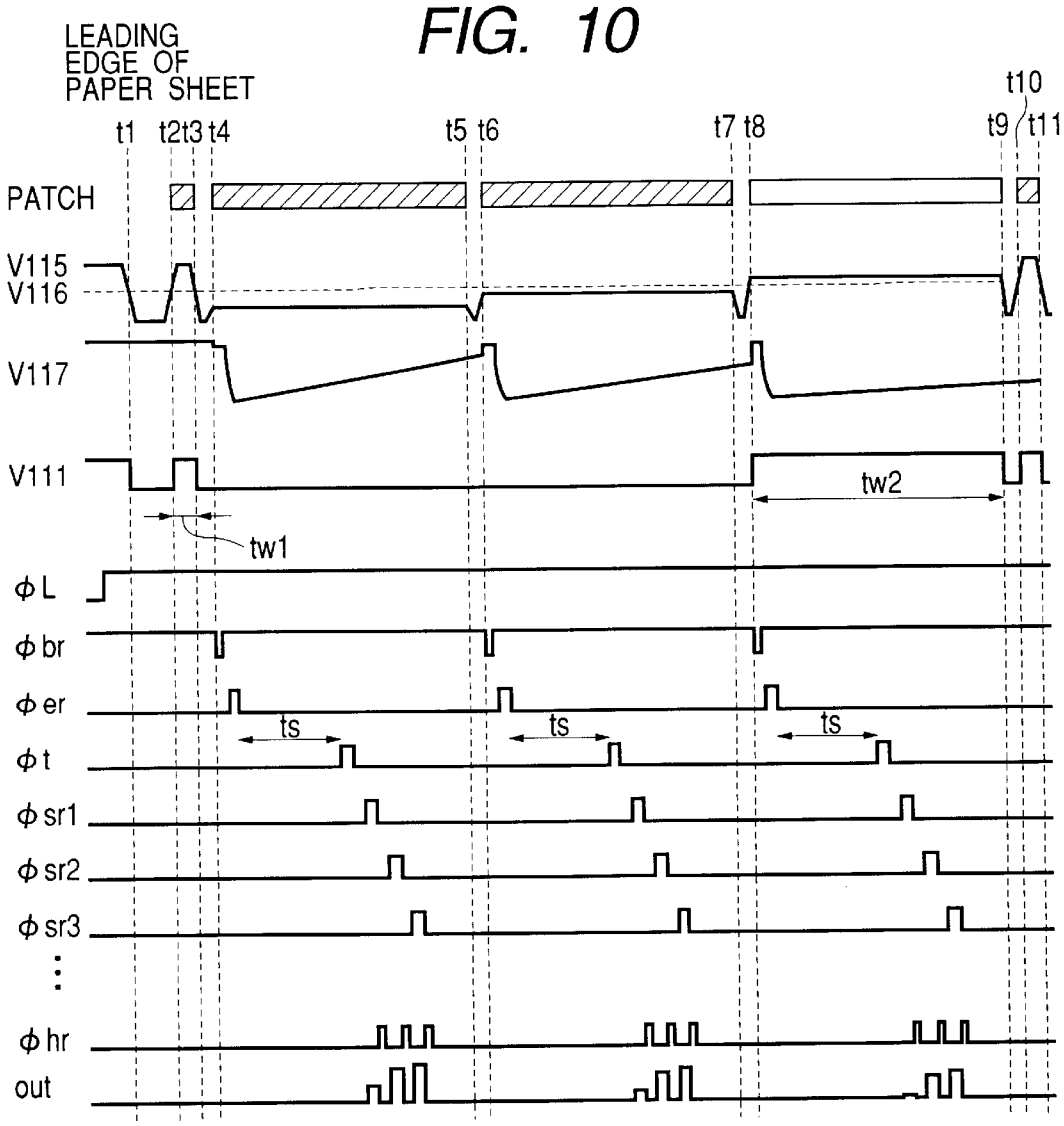
FIG. 10 is a timing chart showing the operation of the third embodiment.

FIG. 9 shows an example of toner patches for use in an image forming apparatus as the third embodiment of the invention. FIG. 10 shows a timing chart of an operation of this embodiment.

Like the second embodiment, in this embodiment also, a plurality of toner patches for position detection is provided to realizes an image forming apparatus that does not suffer from detection errors even if changes in the transporting speed of the transfer material 1 occurs. Specifically, as shown in FIG. 9, a toner patch 151 for position detection is provided for every several toner patches 152, 153 and 154 for color tint detection or density detection.

The hardware structure of this embodiment is the same as that of the first embodiment except for the shape of the toner patch, so the reference is made to FIGS. 1 to 4 as well as the related descriptions presented above and redundant descriptions will be omitted.

In the following, the operation of the apparatus using the toner patches shown in FIG. 9 will be described with reference to a timing chart shown in FIG. 10. In the second embodiment, the toner patch for position detection is provided for each of the toner patches for color tint detection or density detection. However, changes in the transporting speed do not occur frequently. In addition, an increase in the number of the toner patches for position detection leads to reduction of the number of the toner patches for color tint detection or density detection that can be formed on one sheet. In view of the above, this embodiment shows an example of an toner patch arrangement in which a plurality of toner patches for position detection are provided in a series of toner patches, specifically an example in which a toner patch for position detection is provided for every three toner patches for color tint detection or density detection. First, the CPU turns the control signal $\phi$L to high so as to turn the LED 142 on. Unless the transfer material 1 arrives at the detection area of the sensor, light is not incident on the sensor 141 of the synchronization circuit, so that the monitor output V115 is high. When at time t1 the transfer material 1 having been transferred with the toner patches arrives at the detection area of the sensor including the synchronization circuit 102, the sensor receives reflected light from the transfer material 1, so that the monitor output V115 is turned to low. When at time t2 the first toner patch for position detection arrives at the detection area of the sensor, the reflected light is greatly reduced, and the monitor output V115 increases to exceed the reference voltage V116, so that the output of the comparator 110 is inverted. Accordingly, the output V111 of the synchronization circuit 102 becomes high. When at time t3, the toner patch for position detection leaves the detection area, the reflection light is increased, so that the output of the comparator 110 of the synchronization circuit 102 is inverted and the output V111 becomes low. The CPU detects this second fall of the output V111 to control the operation of the accumulation type sensor 101, so that the setting of the timing of the accumulation in synchronization with the positions of the toner patches for color tint detection or density detection is made possible.

The operations concerning the resetting, accumulation and readout of the accumulation type sensor 101 in this embodiment are the same as those in the first embodiment, and the descriptions thereof will be omitted. In this embodiment, the toner patch for position detection is provided for every three toner patches for color tint detection or density detection. Therefore, after the sensor output corresponding to the first toner patch for color tint detection or density detection is read out, the resetting of the accumulation type sensor 101, the accumulation of the signal from the toner patch and the readout are further repeated twice at specific intervals determined by the speed of the intermediate transfer member 12 and the size of one toner patch. After that, the synchronization circuit 102 enters a monitor state for monitoring the output V111 of the comparator. When at time t11, the trailing edge of the next toner patch for position detection (i.e. the falling edge of the output V111) is detected the CPU causes the accumulation type sensor 101 to start the next cycle of the operations such as resetting, accumulation and readout. In this connection, in the case in which the reflectance of a toner patch for color tint detection or density detection is low, the output V111 of the comparator 110 becomes high even during the detection of that toner patch (for example, as shown in the time interval between t8 and t9 in the chart of FIG. 10). In view of this fact, the CPU determines whether the output is a signal from a toner patch for position detection or from a toner patch for color tint detection or density detection based on the pulse width of the signal of the output V111, which utilizes the fact that the toner patch for position detection is made shorter than the toner patch for color tint detection or density detection, since the detection of the toner patch for position detection does not require the accumulation. As shown in FIG. 10, there is a gap (corresponding to the time interval between t9 and t10) between the toner patch for position detection and the toner patch for color tint detection or density detection. The output V111 of the comparator once becomes low between the toner patch for position detection and the toner patch for color tint detection or density detection, upon detection of reflection light from the transfer material 1 at that gap. If the signal level does not fall to low after the elapse of a time corresponding to the width of the toner patch for position detection, as is the case with tw2 in FIG. 10, it is determined that the detected signal corresponds not to the toner patch for position detection but to the toner patch for color tint detection or density detection, so that errors in the operations can be avoided.

By repeating the above-described process, it is possible to perform the operations of the accumulation type sensor in synchronization with the arrivals of the toner patches at the detection area of the sensor throughout the toner patches, while avoiding reduction in the number of the toner patches for color tint detection or density detection. In addition, even if the above-mentioned problem such as slippage of the transfer material 1 due to wear of a roller occurs, the color tint or density or the toner patches can be detected accurately, so that it is possible to obtain reliable data to be used for various controlling of the image forming apparatus.

Embodiment 4

Figure 11:
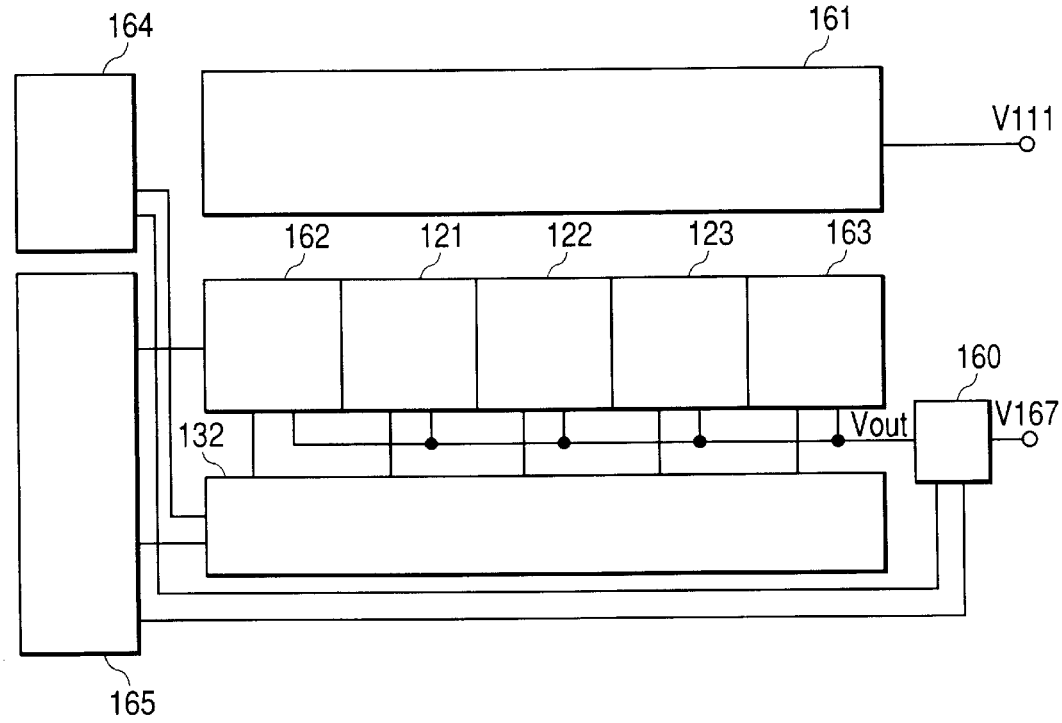
FIG. 11 is a block diagram of the accumulation type sensor and the synchronization circuit used in the fourth embodiment of the present invention.

FIG. 11 shows a block diagram of an accumulation type sensor and a synchronization circuit used in the fourth embodiment of the invention. In this embodiment, the accumulation type sensor and the synchronization circuit are formed on the same single semiconductor substrate. On the other hand, in the forgoing three embodiments, the accumulation type sensor and the synchronization circuit are separately formed. In the latter case, two types of sensors and peripheral circuits are to be manufactured separately and then mounted, which involve an additional cost. This fourth embodiment can save such a cost.

In the following, a description will be made of a structure of the accumulation type sensor and the synchronization circuit with reference to FIG. 11. Reference numerals 121 to 123 denote accumulation type sensors, which were described above with reference to FIG. 5. The surface of each of the accumulation type sensors is covered with a R, G or B filter and each sensor detects a signal component of reflected light from the toner surface that has passed through each filter. The blocks denoted by reference numerals 162 and 163 are dummy blocks that have the same circuit structure as the sensor 121, or dark pixels the surfaces of which are shielded from light for obtaining signals used for dark current correction of the sensors. In the example of FIG. 11, each dummy block is comprised of one block, but each dummy block may be comprised of a plurality of blocks. Reference numeral 132 denotes a shift register for reading out the outputs of the accumulation type sensor sequentially. Reference numeral 165 denotes a timing generator for generating a driving signal for controlling the resetting and accumulation of the sensors. In the case in which all of the driving signals are supplied by a CPU (not shown), the timing generator may be replaced by an input buffer. Reference numeral 164 denotes a reference voltage generator for generating a reset voltage for the sensors. The block denoted by reference numeral 160 represents a resetting circuit for the readout line of the NMOSFET 131 shown in FIG. 5 and a circuit for amplifying or buffering the output of the sensors. Reference numeral 161 denotes a synchronization circuit including the photodiode shown in FIG. 3.

In order to form these circuits on the same semiconductor substrate, a semiconductor process that can form NPN transistors, CMOS transistors, resistances, capacities and photodiodes is required. This can be realized by a BiCMOS device, a cross sectional view of which is shown in FIG. 12.

Figure 12:
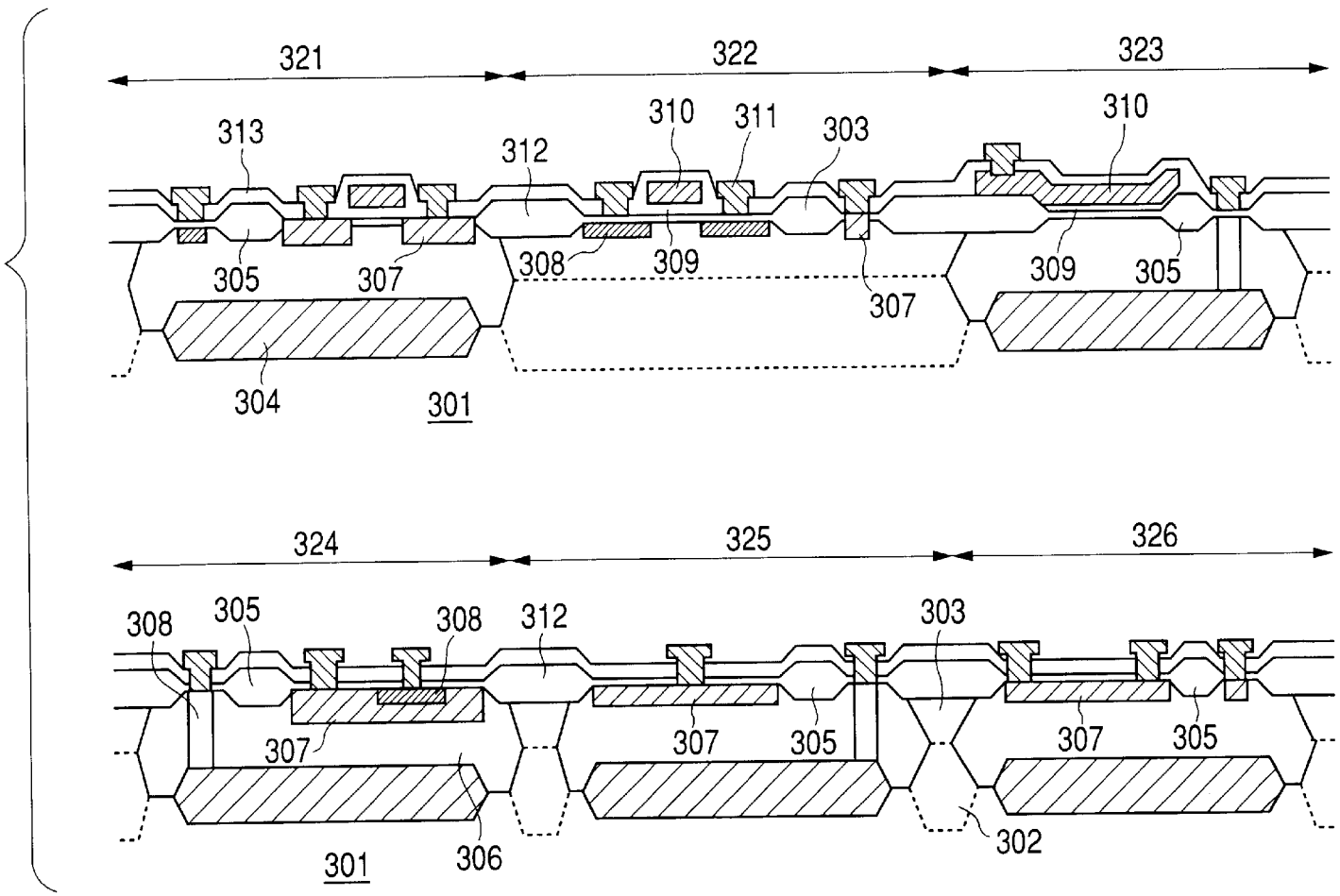
FIG. 12 is a cross sectional view of a device in which the accumulation type sensor and the synchronization circuit are formed on the same single semiconductor substrate.
Figure 13A:
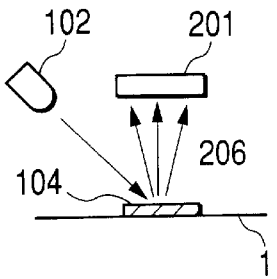
FIGS. 13A and 13B are drawings schematically illustrating a conventional sensor using a photodiode.
Figure 13B:
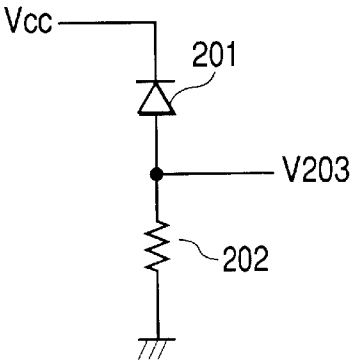
Figure 14:
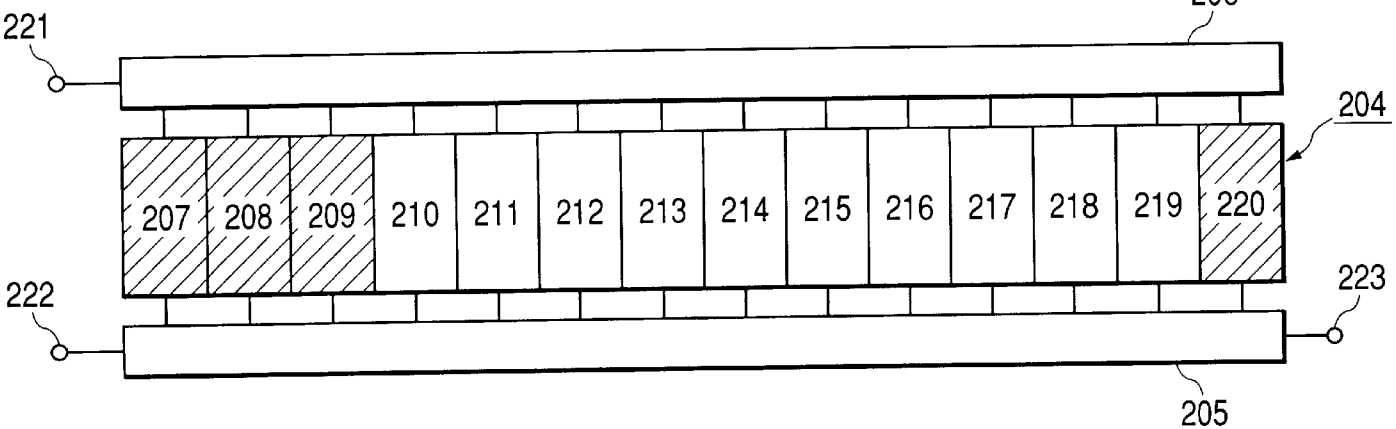
FIG. 14 is a block diagram illustrating a structure of a conventional accumulation type line sensor.
Figure 15:
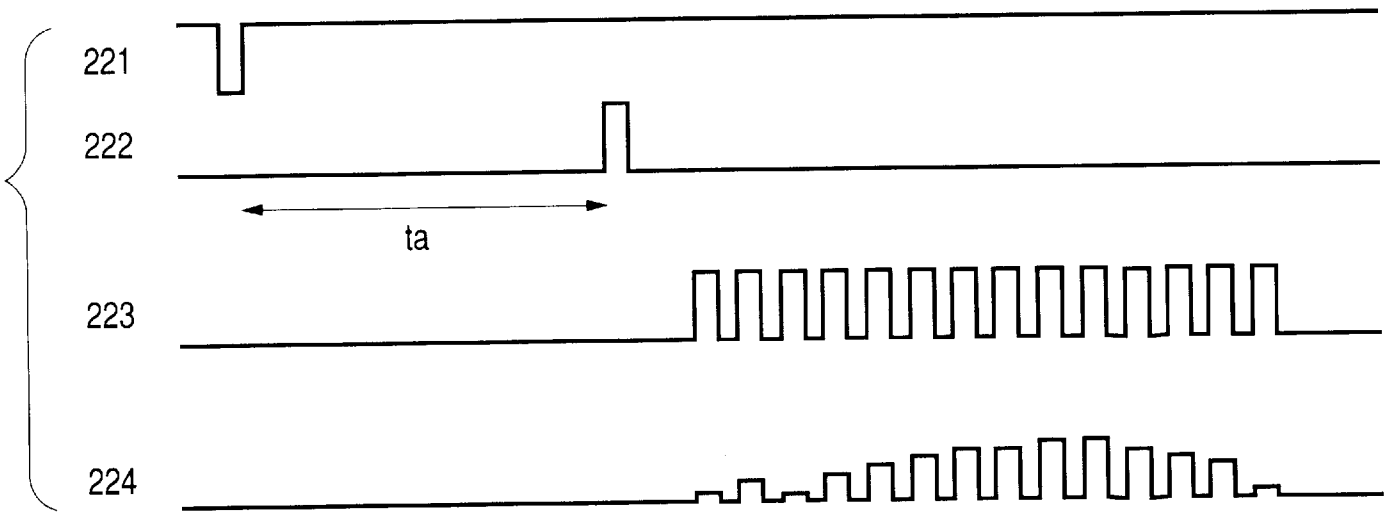
FIG. 15 is a timing chart showing the operation of the line sensor shown in FIG. 14.

The device shown in FIG. 12 includes a p-type semiconductor substrate 301, a p-type embedded layer 302, an n-type embedded layer 304, an n-type epi-layer 305, a p-type well 303, and a p-type diffusion layer 306 of a low concentration that constitutes an base area of an npn transistor. Reference numeral 307 denotes a p-type diffusion layer having a high concentration that constitutes a contact area or the like for a source drain of a PMOS, a resistance, the p-type well and the base of the npn transistor. Reference numeral 308 denotes an n-type diffusion layer that constitutes a contact area for a base drain of an NMOS, an emitter of the npn transistor and an epi-layer. The device further includes a thick oxide film area 312 for dividing the device, a thin gate oxide film 309, a deep n-type diffusion layer 308 for making contact with the n-type embedded layer with low resistance and a polysilicon 310 that constitutes a gate of a MOS and one of the terminals of a capacity. Reference numeral 311 denotes a metal layer for making contact with the diffusion layer and the polysilicon, and reference numeral 313 denotes an insulating film between the layers. In FIG. 12, the illustration of the structure above the first metal layer is omitted, but in practice, there are further layers such as multi-layered wirings, protect layers and color filters etc. laminated thereon.

In FIG. 12, area 321 indicates the PMOS transistor with a polysilicon gate, area 322 indicates the NMOS transistor with a polysilicon gate, area 323 indicates the capacity including the gate oxide film as dielectric, area 324 indicates the npn transistor, area 325 indicates a photodiode including a p-type diffusion layer and an n-type epitaxial layer, and area 326 indicates the structure of the resistance constituted by a p-type diffusion layer. The structure shown in FIG. 12 can be manufactured by a normal process for manufacturing BASISs. If a CMOS sensor is used as the accumulation type sensor, the npn transistor in area 324 becomes useless, but such a structure also realized in a similar manner.

The operations of the accumulation type sensors and the synchronization circuit in this embodiment is the same as those in the first to third embodiments, so the description thereof will be omitted.

By utilizing the above type of semiconductor device, it is made possible to integrate the synchronization circuit and the accumulation type sensor on the same single chip. Thus, this embodiment can not only save the mounting cost, but also eliminate an error in mounting positions of adjacent two blocks. Therefore, the margin required for the width of the toner patch for color tint detection or density detection (which margin means an additional length of a toner patch in addition to the length required for the resetting, accumulation and readout of the sensor, in view of an error in a detection position of the synchronization circuit and the accumulation type sensor) can be minimized.

It should be noted that the technologies of the above-described embodiments also apply effectively to monochromatic image forming apparatus.

As described above, according to one aspect of the invention, the accumulation type sensor is used for color tint detection or density detection (i.e. detection of image formation characteristics) of the toner on the paper sheet (i.e. transfer material) or on the intermediate transfer member, so it is possible to obtain a signal having a good S/N ratio based on a little quantity of diffused reflected light from the toner patches, even if the quantity of light is further reduced by passing through a color filter or through a diffraction grating or a prism for spectrophotometry. Furthermore, the image forming apparatus forms the toner patch for position detection and has the synchronization circuit for detecting this toner patch for position detection, so that it is possible to determine accurate timing of arrival of the patches for color tint detection or density detection at the detection area of the sensor. Therefore, it is not necessary to set a margin for the sizes of the toner patches for color tint detection or density detection, and an increased number of detection patches can be formed in a limited time and in a limited length of the intermediate transfer member or transfer material, so that information to be used for color stabilization control can be increased while enhancing the usability of the apparatus. In other words, it is possible to provide an image forming apparatus having good color stability without reducing the usability.

Furthermore, according to another aspect of the invention, a toner patch for position detection is provided for each of a plurality of toner patches for color tint detection or density detection, and the detecting operation of the accumulation type sensor is controlled in synchronization with the transportation of the toner patches for color tint detection or density detection. Therefore, it is not necessary to set a margin to the size of the toner patch for color tint detection or density detection in order to compensate for changes in the time of the arrival of the toner patch for color tint detection or density detection due to changes in the transporting speed of the transfer material etc. Accordingly, an increased number of detection patches can be formed in a limited time and in a limited length of the intermediate transfer member or transfer material, so that information to be used for color stabilization control can be increased without reducing the usability of the apparatus. In other words, it is possible to provide an image forming apparatus having good color stability without reducing the usability.

Still further, according to another aspect of the invention, the accumulation type sensor and the synchronization circuit including the sensor that can detect reflected light in real time are formed on the same single semiconductor substrate. With this structure, it is possible to detect the color tint or density of toner at a low cost, namely it is possible to provide an image forming apparatus having good image stability at a low cost.

While the invention has been described with reference to preferred embodiments, the present invention is not limited to those embodiments. It is apparent that various modifications or changes can be made within the scope of the annexed claims.

What is claimed is:

1. An image forming apparatus comprising:

an image forming unit adapted to form an image;

a patch forming unit adapted to cause said image forming unit to form a patch for image formation characteristics detection and a patch for position detection;

a first detector, adapted to detect a patch for image formation characteristics detection formed by said image forming unit in order to control an image forming condition;

a second detector, adapted to detect a patch for position detection; and a controller adapted to control, in response to the detection by said second detector, a detecting operation of said first detector.

2. An image forming apparatus according to claim 1, wherein said patch forming unit forms a patch for position detection for every patch formed for image formation characteristics detection, and said controller controls the detecting operation of said first detector based on a timing of the position detection of each patch by said second detector.

3. An image forming apparatus according to claim 1, wherein, said patch forming unit forms a patch for position detection for each of the several patches formed for image formation characteristics detection, and said controller controls the detecting operation of said first detector based on a timing of the position detection of each patch by said second detector.

4. An image forming apparatus according to claim 1, wherein said first detector comprises an accumulation type sensor including a light source having a spectrum that covers all of the visible light range and pixels provided with filters, wherein the filters have three or more spectroscopic characteristics.

5. An image forming apparatus according to claim 1, wherein said first detector comprises an accumulation type sensor including a light source having a spectrum that covers all of the visible light range, a color separator adapted to separate light into lights of a plurality of colors, and a plurality of pixels on each of which light separated by said color separator is incident.

6. An image forming apparatus according to claim 1, wherein said first detector comprises an accumulation type sensor including three or more light sources having different spectroscopic characteristics and one or more pixels that are not provided with a filter that restricts the wavelength of incident light.

7. An image forming apparatus according to claim 6, wherein said apparatus performs a detecting operation with one of the light sources in which reflected light from one patch to be detected is detected under a state in which only one of the light sources is turned on, and repeats the detecting operation with each of the light sources.

8. An image forming apparatus according to claim 1, wherein said second detector comprises a light sensor arranged to detect a quantity of incident light in real time, a circuit for current-to-voltage-converting a photocurrent from said light sensor, and a comparator arranged to compare an output of said circuit and a specific voltage.

9. An image forming apparatus according to claim 1, wherein said patch forming unit forms patches in such a way that a length in a transporting direction of the patch for position detection is smaller than the length the transporting direction of the patch for image formation characteristics detection, and that there is a space between the patch for position detection and the patch for image formation characteristics detection so that said first detector can detect reflected light from a substrate material at that space.

10. An image forming apparatus according to claim 1, wherein said first detector and said second detector are formed on a same single semiconductor substrate.

11. An image forming apparatus according to claim 1, wherein the patch for image formation characteristics detection detected by said first detector is single-colored or mixed-colored.

12. An image forming apparatus according to claim 1, further comprising means for controlling at least one of density, tone reproduction and color tint of a toner image based on the detection result of said first detector.

13. An image forming apparatus according to claim 1, wherein said image forming unit forms an image on a photosensitive member, and transfers the image formed on said photosensitive member onto an intermediate transfer member, and then transfers the image on said intermediate transfer member onto a transfer material, and wherein said patch forming unit causes said image forming apparatus to form the patch for image formation characteristics detection and the patch for position detection on said intermediate transfer member.

14. An image forming apparatus according to claim 1, wherein said image forming unit forms an image on a photosensitive member, and transfers the image formed on said photosensitive member onto a transfer material directly, and wherein said patch forming unit causes said image forming apparatus to form the patch for image formation characteristics detection and the patch for position detection on said transfer material.

15. A method for detecting a patch for controlling image formation characteristics of an image forming apparatus, using a first sensor and a second sensor, comprising the steps of:

causing the image forming apparatus to form a patch for image formation characteristics detection and a patch for position detection;

detecting the patch for position detection formed by the image forming apparatus, using the second sensor;

controlling, in response to detection by the second sensor, a detecting operation of the first sensor; and detecting the patch for image formation characteristic detection formed by the image forming apparatus based on detection by the first sensor so as to obtain information on image formation characteristics of the image forming apparatus.

16. An image forming apparatus comprising:

an image forming unit adapted to form an image;

a patch forming unit adapted to cause said image forming unit to form patches;

a first detector, adapted to detect a patch formed by said image forming unit in order to control an image forming condition;

a second detector, adapted to detect a patch formed by said image forming unit in order to control a timing of operation of said first detector; and a controller adapted to control, in response to the detection by said second detector, a detecting operation of said first detector.

17. An image forming apparatus according to claim 16, wherein said first detector comprises an accumulation type sensor including a light source having a spectrum that covers all of the visible light range and pixels provided with filters, the filters having three or more spectroscopic characteristics.

18. An image forming apparatus according to claim 16, said first detector comprises an accumulation type sensor including a light source having a spectrum that covers all of the visible light range, a color separator adapted to separate light into lights of a plurality of colors, and a plurality of pixels on each of which light separated by said color separator is incident.

19. An image forming apparatus according to claim 16, wherein said first detector comprises an accumulation type sensor including three or more light sources having different spectroscopic characteristics and one or more pixels that are not provided with a filter that restricts the wavelength of incident light.

20. An image forming apparatus according to claim 16, wherein said second detector comprises a light sensor arranged to detect a quantity of incident light in real time, a circuit for current-to-voltage-converting a photocurrent from said light sensor, and a comparator arranged to compare an output of said circuit and a specific voltage.

21. An image forming apparatus according to claim 16, wherein said first detector and said second detector are formed on one single semiconductor substrate.

22. An image forming apparatus according to claim 16, wherein the patch for image formation characteristics detection detected by said first detector is single-colored or mixed-colored.

23. An image forming apparatus according to claim 16, further comprising means for controlling at least one of density, tone reproduction and color tint of a toner image based on a detection result of said first detector.

24. An image forming apparatus to claim 16, wherein said image forming unit forms an image on a photosensitive member, and transfers the image formed on said photosensitive member onto an intermediate transfer member, and then transfers the image on said intermediate transfer member onto a transfer material, and wherein said patch forming unit causes said image forming apparatus to form the patch for image formation characteristics detection and the patch for position detection on said intermediate transfer member.

25. An image forming apparatus according to claim 16, wherein said image forming unit forms an image on a photosensitive member, and transfers the image formed on said photosensitive member onto a transfer material directly, and wherein said patch forming unit causes said image forming apparatus to form the patch for image formation characteristics detection and the patch for position detection on said transfer material.

26. A method of detecting a patch for controlling image formation characteristics of an image forming apparatus, using a first sensor and a second sensor, comprising the steps of:

causing the image forming apparatus to form patches;

detecting with the second sensor, the patch formed by the image forming apparatus in order to control a timing of operation of the first sensor;

controlling, in response to the detection by the second sensor, a detecting operation of the first sensor; and detecting with the first sensor, the patch formed by the image forming apparatus in order to control an image forming condition.

* * * * *

UNITED STATES PATENT AND TRADEMARK OFFICE

CERTIFICATE OF CORRECTION

PATENT NO. : 6,731,889 B2
DATED : May 4, 2004
INVENTOR(S) : Toshiki Nakayama

It is certified that error appears in the above-identified patent and that said Letters Patent is hereby corrected as shown below:

Column 1,
Line 34, “pixel” should read -- pixels --.

Column 6,
Line 37, “a” should read -- an --.

Column 8,
Line 47, “per,” should read -- Φer, --.

Column 9,
Line 7, “an” should read -- a --; and
Line 57, “pixel” should read -- pixels --.

Column 12,
Line 67, “realizes” should read -- realize --.

Column 13,
Line 22, “an” should read -- a --.

Column 15,
Line 25, “constitutes an” should read -- constitutes a --.

Column 17,
Line 64, “length” should read -- length in --.

UNITED STATES PATENT AND TRADEMARK OFFICE

CERTIFICATE OF CORRECTION

PATENT NO. : 6,731,889 B2
DATED : May 4, 2004
INVENTOR(S) : Toshiki Nakayama

It is certified that error appears in the above-identified patent and that said Letters Patent is hereby corrected as shown below:

Column 19,
Line 29, "apparatus" should read -- apparatus according --.

Signed and Sealed this

Sixth Day of September, 2005

JON W. DUDAS
*Director of the United States Patent and Trademark Office*